US012409913B2

(12) United States Patent
Wu

(10) Patent No.: US 12,409,913 B2
(45) Date of Patent: Sep. 9, 2025

(54) SURFBOARD LEASH ATTACHMENT STRAP AND SURFBOARD LEASH ASSEMBLY

(71) Applicant: Nantong Shakamma Sports Goods Co., Ltd., Nantong (CN)

(72) Inventor: Yongkang Wu, Nantong (CN)

(73) Assignee: Nantong Shakamma Sports Goods Co., Ltd., Nantong (CN)

( * ) Notice: Subject to any disclaimer, the term of this patent is extended or adjusted under 35 U.S.C. 154(b) by 453 days.

(21) Appl. No.: 18/164,076

(22) Filed: Feb. 3, 2023

(65) Prior Publication Data

US 2024/0158054 A1 May 16, 2024

(30) Foreign Application Priority Data

Nov. 11, 2022 (CN) ..... 202211411029.X

(51) Int. Cl.
*B63B 32/40* (2020.01)
*B63B 32/73* (2020.01)
*B63B 32/77* (2020.01)

(52) U.S. Cl.
CPC ..... *B63B 32/45* (2020.02); *B63B 32/73* (2020.02); *B63B 32/77* (2020.02)

(58) Field of Classification Search
CPC ..... B63B 32/45; B63B 32/73
See application file for complete search history.

(56) References Cited

U.S. PATENT DOCUMENTS 5,738,556 A 4/1998 Palmieri
6,000,979 A * 12/1999 Stewart ..... B63B 32/22 441/75
6,471,560 B2 * 10/2002 Kerckhoff ..... B63B 32/70 441/75

(Continued)

FOREIGN PATENT DOCUMENTS

CN 201712773 U 1/2011
CN 210310792 U 4/2020

(Continued)

OTHER PUBLICATIONS

International Search Report mailed on Nov. 18, 2023 in PCT/CN2023/125140.

(Continued)

*Primary Examiner* — Juan G Flores
(74) *Attorney, Agent, or Firm* — Fox Rothschild LLP

(57) ABSTRACT

A surfboard leash attachment strap and a surfboard leash assembly are provided. The attachment strap includes an attachment strap body comprising a first section, a second section and a pull handle member, wherein, the first section is connected to a first end of the second section, an outer surface of the first section is provided with a first cooperating member, a second end of the second section is connected to the pull handle member, the attachment strap body is integrally molded as a one piece structure; a first fixing member fixed on the first section of the attachment strap body; and a second fixing member fixed on the second section of the attachment strap body, wherein the second (Continued)

fixing member is separably connected to the first fixing member. The strength of the surfboard leash attachment strap is enhanced, and the assembly process is simplified.

20 Claims, 15 Drawing Sheets

(56) References Cited

U.S. PATENT DOCUMENTS

| | | | | |
|---|---|---|---|---|
| 8,894,457 | B1 | 11/2014 | Crozier | |
| 11,273,888 | B2 * | 3/2022 | West | B63B 32/73 |
| 2002/0090870 | A1 * | 7/2002 | Kerckhoff | B63B 32/70<br>441/75 |
| 2013/0130579 | A1 * | 5/2013 | Nolan | B63B 32/70<br>29/446 |
| 2020/0269958 | A1 * | 8/2020 | West | B63B 34/60 |

FOREIGN PATENT DOCUMENTS

| | | | |
|---|---|---|---|
| CN | 112793719 | A | 5/2021 |
| CN | 218662282 | U | 3/2023 |
| JP | H0976990 | A | 3/1997 |
| WO | 2017181225 | A1 | 10/2017 |

OTHER PUBLICATIONS

Examination Report No. 1 mailed on Jul. 7, 2025 in Australian Patent Application No. 2023376286.

* cited by examiner

SURFBOARD LEASH ATTACHMENT STRAP AND SURFBOARD LEASH ASSEMBLY

CROSS-REFERENCE TO RELATED APPLICATIONS

This application is based upon and claims priority to Chinese Patent Application No. 202211411029.X, filed on Nov. 11, 2022, the entire contents of which are incorporated herein by reference.

TECHNICAL FIELD

The present disclosure relates to surfboard leash technology, and more particularly to a surfboard leash attachment strap and a surfboard leash assembly.

BACKGROUND

During surfing, people use a surfboard leash assembly to connect a surfboard and human body parts. Therefore, the surfboard leash assembly plays an important role in ensuring the personal safety of users. The existing surfboard leash assembly generally includes an attachment strap, a cord and a board connector, wherein the attachment strap and the board connector are respectively connected to two ends of the cord. At the time of use, the attachment strap is attached to a certain part of the human body, such as the ankle, wrist, arm, leg, etc., while the board connector is connected to the surfboard. The traditional attachment strap mainly comprises a fabric attachment strap body and two fixing members respectively arranged at two ends of the attachment strap body. The outside of the attachment strap body is fixed with a plastic cooperating member that is used to connect the cord and a pull handle member. When the attachment strap is assembled, it is necessary to assemble the attachment strap body with the cooperating member, the pull handle member, and the two fixing members in turn. The production process is relatively complex, and the connection strength between different members cannot be guaranteed. In addition, at the time of using the attachment strap, the cooperating member needs to be capable of bearing a large force. The cooperating member may accidentally separate from the attachment strap body due to excessive external force, seriously affecting the life safety of the user. When the user needs to quickly take off the attachment strap in an emergency, the user applies a relatively large force to the pull handle member. If the pull handle member accidentally separates from the attachment strap body, the attachment strap cannot be released smoothly, also seriously affecting the life safety of the user.

SUMMARY

In the present disclosure, a surfboard leash attachment strap and a surfboard leash assembly are provided. The attachment strap includes: an attachment strap body including a first section, a second section and a pull handle member, wherein, the first section is connected to a first end of the second section, an outside of the first section is provided with a first cooperating member, a second end of the second section is connected to the pull handle member, the attachment strap body is integrally molded as a one piece structure; a first fixing member fixed on the first section of the attachment strap body; and a second fixing member fixed on the second section of the attachment strap body, wherein the second fixing member is separably connected to the first fixing member.

The surfboard leash assembly includes: the above surfboard leash attachment strap; a cord comprising a second cooperating member and a third cooperating member, and the second cooperating member is connected to the first cooperating member of the attachment strap; a board connector connected to the third cooperating member of the cord; and a connecting ring connected to the board connector.

It should be readily understood that both the foregoing general description and the following detailed description are exemplary and explanatory only, and are not intended as a limitation to the scope of the present disclosure.

BRIEF DESCRIPTION OF THE DRAWINGS

The foregoing and other features, and advantages of the disclosure are apparent from the following detailed description taken in conjunction with the accompanying drawings in which.

DETAILED DESCRIPTION

In the following, embodiments of the present disclosure will be described in detail with reference to the figures. The concept of the present disclosure can be implemented in a plurality of forms, and should not be understood to be limited to the embodiments described hereafter. In the contrary, these embodiments are provided to make the present disclosure more comprehensive and understandable, and so the conception of the embodiments can be conveyed to those skilled in the art fully. The same reference signs in the figures refer to the same or similar elements, so repeated description of them will be omitted. The term "or" in the description may mean "and" or "or". Although the terms "up", "down", "between" and the like may be used in this description to describe different exemplary features and elements of the disclosure, these terms are used herein only for convenience. For example, the direction is defined according to the exemplary direction shown in the accompanying drawings. None of the features in the description should be understood as requiring a specific three-dimensional direction of structure to define the protection scope of the disclosure. Although "the first" or "the second" is used in this description to represent some features, they are only used exemplarily, not as a limit to the number and importance of specific features.

Figure 1:
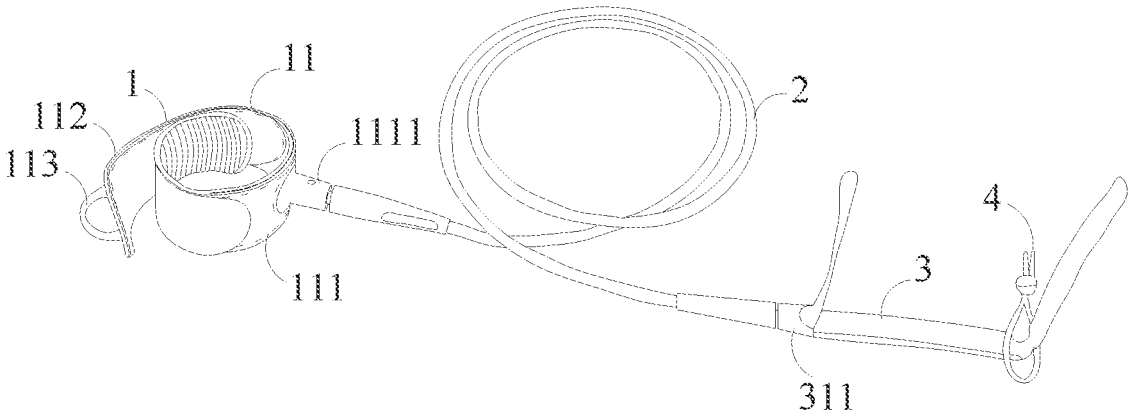
FIG. 1 is a structural schematic view of a surfboard leash assembly according to a first embodiment of the present disclosure.
Figure 2:
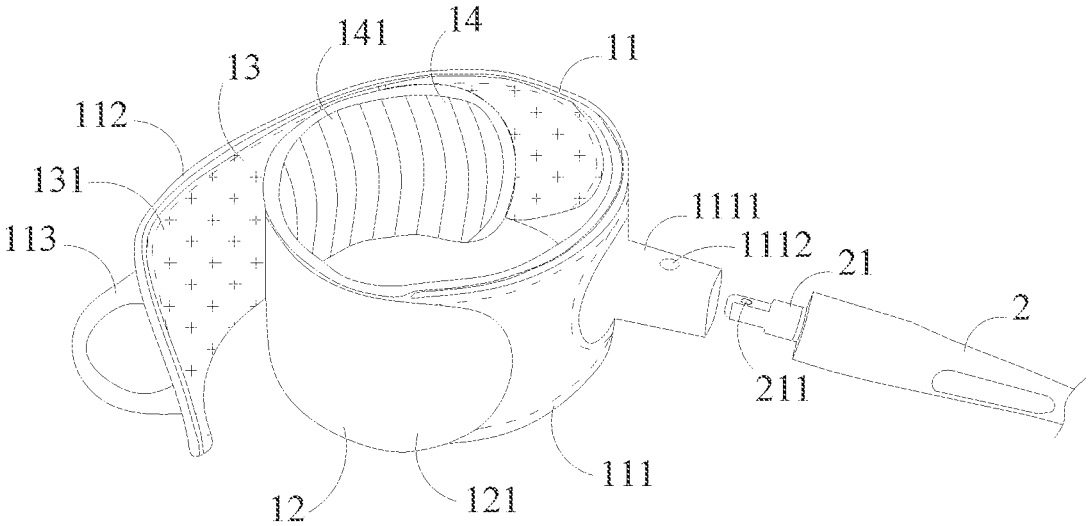
FIG. 2 is a structural schematic view of an attachment strap cooperating with a cord according to the first embodiment of the present disclosure.

As shown in FIGS. 1 and 2, in the first embodiment, a surfboard leash attachment strap 1 and a surfboard leash assembly including the attachment strap 1 are provided. The surfboard leash assembly includes the surfboard leash attachment strap 1 that connects a human body part, a cord 2 having two ends, a board connector 3 and a connecting ring 4. At the time of use, the attachment strap 1 is attached to the human body part, which may be the ankle, wrist, arm, leg, or any of other parts of the human body, preferably the ankle. The two ends of the cord 2 are respectively connected to the attachment strap 1 and the board connector 3. The board connector 3 is connected to the surfboard through the connecting ring 4. The attachment strap 1 includes an attachment strap body 11, a first fixing member 12 and a second fixing member 13. The first fixing member 12 and the second fixing member 13 are respectively arranged at two ends of the attachment strap body 11. The first fixing member 12 and the second fixing member 13 can be connected together to form a ring attached to and surrounding the human body part.

As shown in FIGS. 2 to 6, the attachment strap body 11 includes a first section 111, a second section 112 and a pull handle member 113. The first section 111 includes a first end and a second end, and the second section 112 includes a first end and a second end. The first fixing member 12 includes a first end and a second end. The first end of the first fixing member 12 is fixed at the first end of the first section 111, and the second end of the first fixing member 12 is a terminal end of the first fixing member 12. The second end of the first section 111 is connected to the first end of the second section 112. In another embodiment, the first fixing member 12 can also be partially overlapped with the first section 111. An outer surface of the first section 111 is provided with a first cooperating member 1111 for connecting the cord 2, which protrudes outward relative to the outer surface of the first section 111. One end of the cord 2 is provided with a second cooperating member 21. For example, the second cooperating member 21 can be a metal piece or other piece with high hardness. The first cooperating member 1111 is fixedly connected to the second cooperating member 21. In this embodiment, the first cooperating member 1111 is provided with first pin holes 1112, the second cooperating member 21 is provided with a second pin hole 211, and the second cooperating member 21 can be inserted into the first cooperating member 1111. The first cooperating member 1111 and the second cooperating member 21 are fixedly connected by a fixed pin passing through the first pin holes 1112 and the second pin hole 211. The second cooperating member 21 can rotate relative to a terminal end of the cord 2, so that the cord 2 can be rotatably connected to the attachment strap 1. Only one example of the connection structure between the first cooperating member 1111 and the second cooperating member 21 is described here, and the disclosure is not limited to this. In other alternative embodiments, the first cooperating member 1111 and the second cooperating member 21 can also be fixed in other ways, for example, the second cooperating member is formed from plastic instead of metal and provided with holes at one end thereof, and the first cooperating member is inserted into the second cooperating member.

The second fixing member 13 has a first end and a second end. The second fixing member 13 is at least partially attached to an inner surface of the second section 112, the first end of the second fixing member 13 is fixed at a position near the first section 111, and the second end of the second fixing member 13 is a terminal end of the second fixing member 13. In another embodiment, the second fixing member 13 can also be overlapped and fixed with the second end of the second section 112, or the second fixing member 13 can be attached to the outer surface of the second section 112. The outer surface of the second end of the second section 112 is connected to the pull handle member 113. The attachment strap body 11 is integrally molded as a one piece structure, that is, the first section 111, the second section 112, the first cooperating member 1111 and the pull handle member 113 are integrally molded as a one piece structure. Furthermore, the first section 111, the second section 112, the first cooperating member 1111 and the pull handle member 113 of the attachment strap body 11 are formed in a one step process. The first section 111, the second section 112, the first cooperating member 1111 and the pull handle member 113 of the attachment strap body 11 are formed in a molding apparatus. Therefore, the attachment strap body 11 can be produced conveniently, that is, the attachment strap body 11 can be obtained by one molding step with only one molding apparatus, greatly improving the production efficiency of the attachment strap body 11. The molding apparatus can be an injection molding apparatus. For example, the molding apparatus includes a mold having a cavity. Inserting thermoplastic polyurethane elastomer material into the cavity of the mold, the attachment strap body 11 is obtained through a one-step molding process.

An outer surface 121 of the first fixing member 12 is separably connected to an inner surface 131 of the second fixing member 13. For example, each of the first fixing member 12 and the second fixing member 13 includes a hook-and-loop fastener. The outer surface 121 of the first fixing member 12 is a hook surface, and the inner surface 131 of the second fixing member 13 is a loop surface, or the outer surface 121 of the first fixing member 12 is a loop surface, and the inner surface 131 of the second fixing member 13 is a hook surface. In other embodiments, the connection structure between the first fixing member 12 and the second fixing member 13 can also be a button connection structure, a snap connection structure, a threaded connection structure or any other connection structure, for example, the first fixing member 12 is a button, and the second fixing member 13 is a buttonhole.

At the time of using the attachment strap 1, the attachment strap body 11 is attached to the outer surface of the corresponding human body part, and then the outer surface 121 of the first fixing member 12 and the inner surface 131 of the second fixing member 13 are bonded together, so that the attachment strap 1 integrally forms a ring shape. Therefore, the attachment strap 1 is connected to the human body. When the first fixing member 12 is connected to the second fixing member 13, the terminal end (second end) of the second fixing member 13 at least partially covers the first end of the first fixing member 12, and the second end of the second section 112 of the attachment strap body 11 at least partially covers the first end of the first section 111. Therefore, the attachment strap body 11 surrounds the human body part at an angle of 360°. Thus, when an external force is applied on the first cooperating member 111, the force can be dispersed to the whole ring structure of the attachment strap body 11, and further dispersed to the integral ring structure of the whole attachment strap 1. When the user needs to take off the attachment strap 1 from the human body, the user can hook the pull handle member 113 with one finger and pull it outward to separate the second fixing member 13 from the first fixing member 12, and then the attachment strap 1 can be quickly separated from the human body.

Figure 4:
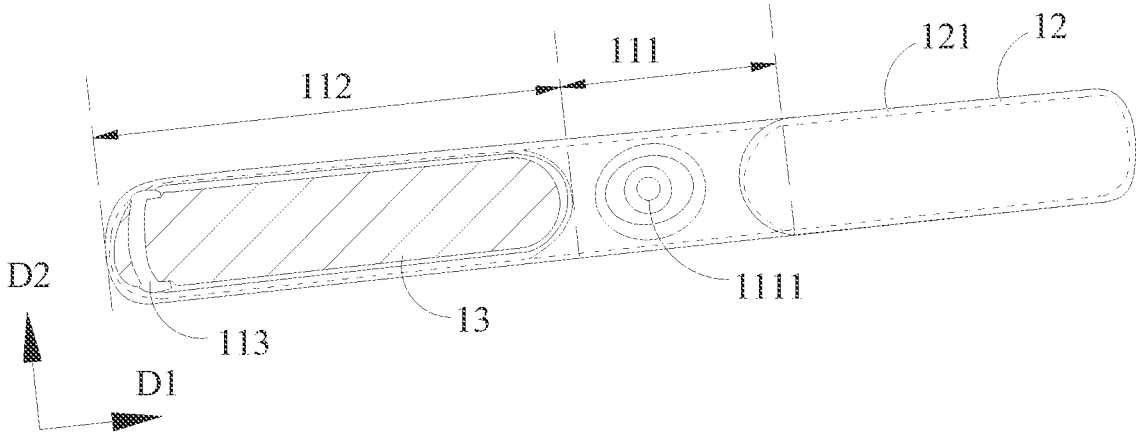
FIG. 4 is a schematic view of an outer surface of the attachment strap after it's spread according to the first embodiment of the present disclosure.

In the present disclosure, the inside and the outside of each member of the attachment strap 1 are defined relative to the human body part that are attached during use. After the attachment strap 1 is attached to the human body, the inside of a component is the side closer to the human body, and the outside of a component is the side away from the human body. The length direction and width direction of the attachment strap 1 refer to the length direction and width direction of the attachment strap 1 after being spread. As shown in FIG. 4, the D1 direction is the length direction of the attachment strap 1, and the D2 direction is the width direction of the attachment strap 1.

In the present disclosure, by providing an integrally molded attachment strap body 11, the cooperation strength between the main part (the arc portion of the first section 111 and the second section 112), the first cooperating member 1111 and the pull handle member 113 of the attachment strap body 11 is improved, and the first cooperating member 1111 and the pull handle member 113 can both bear a great force. When using the attachment strap 1, the connection strength between the first cooperating member 1111 and the cord 2 can be greatly improved, and the connection strength between the pull handle member 113 and the second section 112 of the attachment strap body 11 can be greatly improved, highly improving the safety during use. In addition, when assembling the attachment strap 1, it is only necessary to connect the attachment strap body 11 with the first fixing part 12 and the second fixing part 13, without separately assembling the first cooperating member 1111 and the pull handle member 113 with the attachment strap body 11. The assembly process of the attachment strap body 11 is simpler, greatly improving production efficiency.

In this embodiment, the attachment strap body 11 can be formed by integral injection molding with TPU (thermoplastic polyurethane elastomer) material. The whole cord 2 can also be made of TPU material. However, the disclosure is not limited to this. The attachment strap body 11 and the cord 2 can also be made of other types of materials with high strength and certain flexibility. For example, the attachment strap body 11 and/or the cord 2 can also be made of PVC (polyvinyl chloride), TPE (thermoplastic elastomer) and other materials.

Figure 3:
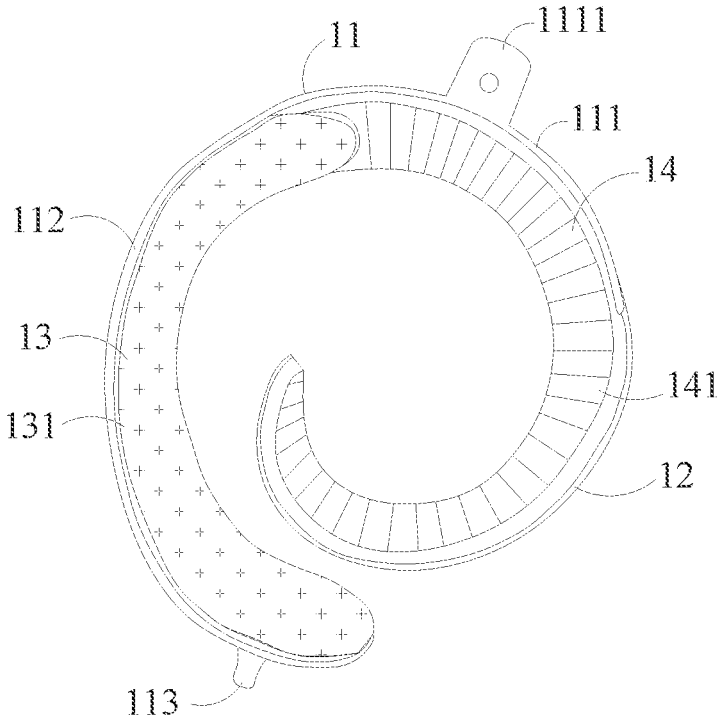
FIG. 3 is a structural schematic view of the attachment strap according to the first embodiment of the present disclosure.

During production, the existing attachment strap generally extends straightly. When the attachment strap is sleeved outside the user's body, the attachment strap is surrounded into an irregular ring shape. Specifically, after the existing attachment strap is surrounded, the surface at the position of the cooperating member still extends straightly due to its high hardness, then the attachment strap body cannot fit well with the radian of the user's body surface. Based on this, as shown in FIG. 3, in this embodiment, the first section 111 is preformed as an arc shape. When the attachment strap 1 is surrounded outside the user's body, the first section 111 can form an arc shape as a whole. In addition, the second section 112 is at least partially flexible. The attachment strap 1 can better fit the radian of the user's body surface as a whole, and can form an arc fitting the user's body surface within a scope of 360°. The arc-shaped part of the first section 111 and the second section 112 are thin and have better flexibility, so the attachment strap 1 can be easily bent and the shape thereof can be adjusted easily. The first cooperating member 1111 is thicker and has certain rigidity, so it can be fixed to the cord 2 more stably. In other alternative embodiments, the first section 111 can also be shaped as extending straightly as a whole and has a good flexibility, which is also within the protection scope of the disclosure.

Figure 5:
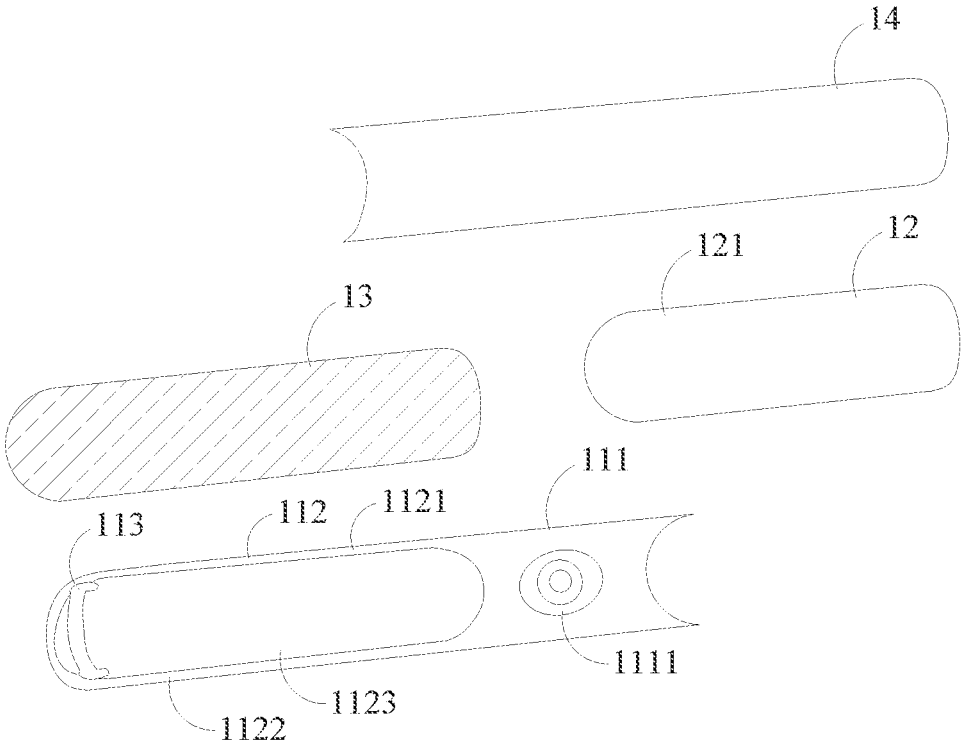
FIG. 5 is an exploded view of the attachment strap according to the first embodiment of the present disclosure.

As shown in FIG. 5, in this embodiment, the second section 112 of the attachment strap body 11 is provided with a hollow portion 1123 extending in the length direction thereof. The outer surface of the second fixing member 13 can be provided with a reinforcing strip, which is exposed at least partially from the hollow part 1123. The reinforcing strip can be made of light, thin and high-strength fabric to strengthen the structure of the second fixing member 13. In another embodiment, the outer surface of the second fixing member 13 may not be provided with a reinforcing strip, and the outer surface of the second fixing member 13 is at least partially exposed from the hollow part 1123. Specifically, the second section 112 of the attachment strap body 11 includes a first arm 1121 and a second arm 1122 both extending along the length direction of the second section 112, and the hollow part 1123 is formed between the first arm 1121 and the second arm 1122. With the hollow part 1123, the second section 112 has better flexibility, and it is easier to bend the second section 112 to fit it to the user's body surface during use. With the hollow part 1123, the overall weight of the attachment strap 1 can be reduced. In this embodiment, the hollow part 1123 is in a shape of a continuous strip. In other embodiments, the hollow part 1123 may also be in other shapes. For example, the hollow part 1123 may be a grid-shaped hollow part, a combination of a plurality of hollow parts arranged side by side, each of the hollow part can be in a shape of a horizontal bar or a vertical bar, etc.

The existing producing method of the pull handle member generally includes the following steps: providing a fabric or plastic strip, enclosing the strip into a ring, and fixing the strip to the end of a fastener through sewing thread to form a pull handle member. The fixing strength between the pull handle member and the attachment strap body is limited by the connection strength of the sewing thread, and the width of the hole formed between the pull handle member and the fastener is smaller, so it may be difficult for users to align their fingers with the hole between the pull handle member and the fastener when using it. The pull handle member made of fabric material is easy to deform due to its lack of stiffness. Therefore, it is easy to deform and difficult to keep the ring shape during use. The hole between the pull handle member and the fastener will also become smaller due to the deformation of the pull handle member. Although the plastic pull handle member has improved the deformation problem, the connection strength between the existing plastic pull handle member and the fastener is not high, and there is a risk of the pull handle member being pulled out of the attachment strap body during use. Moreover, the existing pull handle member needs separate processing and connecting steps, so the manufacturing process is complex. In this embodiment of the present disclosure, the pull handle member 113 and the second section 112 of the attachment strap 1 are integrally molded as a one piece structure, and the two ends of the pull handle member 113 are respectively connected to the first arm 1121 and the second arm 1122, the overall width of the pull handle member 113 is increased. During use, the user can insert their fingers without special effort into the hole between the pull handle member 113 and the second section 112 to pull up the pull handle member 113, the pull handle member 113 can be used more conveniently.

As shown in FIGS. 3-6, in this embodiment, to improve the user's experience and increase the friction between the inner surface of the attachment strap 1 and the user's body surface, the attachment strap 1 further includes a contact member 14, which is at least partially attached to the inner surface of the first section 111 of the attachment strap body 11 and the inner surface of the first fixing member 12. When the attachment strap 1 is sleeved outside the user's body, the contact member 14 is in direct contact with the user's body surface. The inner surface of the contact member 14 is preferably provided with anti-skid patterns. For example, the anti-skid pattens includes a plurality of vertical stripes shown in the figures, or a plurality of convex points, a plurality of oblique stripes, combinations of patterns of various shapes, etc. The contact member 14 is preferably made from a material with a cushioning effect, such as a sponge made of neoprene material, which can give the user a better use experience and a better fixing effect when worn in use. In other embodiments, the contact member 14 can also use EVA (Ethylene Vinyl Acetate Copolymer) materials, silica gel materials, TPE (Thermoplastic Elastomer) or any other material.

Figure 6:
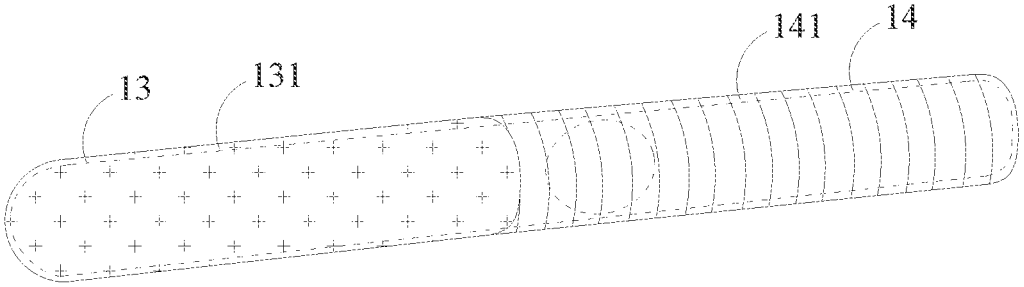
FIG. 6 is a schematic view of an inner surface of the attachment strap after it's spread according to the first embodiment of the present disclosure.

As shown in FIGS. 4-6, in this embodiment, the width of the first fixing member 12, the second fixing member 13, the attachment strap body 11 and the contact member 14 are substantially the same. The attachment strap 1 has a streamlined appearance as a whole, which is more convenient to wear and use, and facilitates the alignment of multiple parts during assembly. The width being substantially the same means that the width of several members can be slightly different, but does not affect the overall streamlined appearance. At the same time, the disclosure is not limited to this. In other embodiments, the width of each member can also be inconsistent, and the width of each member can be adjusted as needed. For example, in another alternative embodiment, the width of each side of the contact member 14 is 1 mm greater (or other values of 2 mm, 1.5 mm, etc.) than the attachment strap body 11, the first fixing member 12 and the second fixing member 13, so as to prevent the edge of the plastic part of the attachment strap body 11 from touching the user's body, and also prevent the edge (the thinner and harder part) of the pricked surface of the first fixing member 12 or the second fixing member 13 from touching the user's body. However, the design does not affect the streamlined appearance. In another embodiment, the edge of a section of the attachment strap body 11 can be retracted to form a groove, so that the width of the attachment strap body 11 is smaller than the width of the contact member 14 by a certain size (such as 1 mm, 2 mm, 1.5 mm, etc.). When assembling the attachment strap 1, one end of the first fixing member 12 can be aligned with the first end of the first section 111 of the attachment strap body 11, and the contact member 14 can be attached to the first section 111 of the attachment strap body 11 and the inside of the first fixing member 12. Attach the second fixing member 13 to the inside of the second section 112 of the attachment strap body 11, and then use sewing thread to fix the first fixing member 12, the second fixing member 13, the attachment strap body 11 and the contact member 14 together. In other embodiments, the first fixing member 12, the second fixing member 13, the attachment strap body 11 and the contact member 14 can also be fixed to each other by other fixing methods, such as gluing, stapling, or a combination of various methods. For example, the first fixing member 12 and the second fixing member 13 are fixed to the attachment strap body 11 by sewing thread, the attachment strap body 11 and the contact member 14 are fixedly connected by glue. The dotted lines in FIGS. 4 and 6 represent sewing lines. Therefore, the assembly process of the attachment strap 1 is simple, and the production of the attachment strap 1 is more convenient and efficient. Also, as shown in FIGS. 4-6, the attachment strap 1 has a streamlined appearance as a whole.

As shown in FIGS. 7 to 10, in this embodiment, the other end of the cord 2 is provided with a third cooperating member 22, and the board connector 3 is connected to the third cooperating member 22 of the cord 2. The connecting ring 4 can be separately connected to the board connector 3. When connecting the board connector 3 to the surfboard, the connecting ring 4 is fixedly connected to the board connector 3 and the surfboard respectively. In other embodiments, the connecting ring 4 can also be fixedly connected to the board connector 3, that is, it cannot be separated from the board connector 3. The existing board connector generally has two separate parts: the cooperating member and the main body part formed separately and the two parts are fixedly connected. At the time of use, the cooperating member may be accidentally separated from the main body part of the board connector, which causes a great security risk. In addition, the assembly process of the existing board connector is relatively complex, resulting low production efficiency. Based on this, the embodiment further provides a new board connector 3, reducing the risk of the cooperating member separating from the main body of the board connector 3 (the first bearing portion 312) accidentally, and the assembly process is easy.

Figure 7:
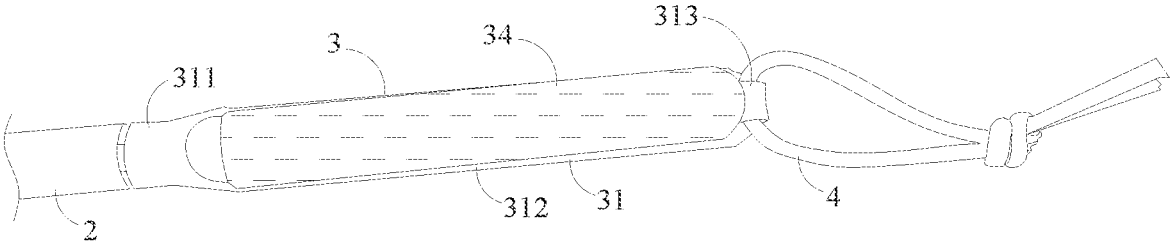
FIG. 7 is a structural schematic view of the board connector according to the first embodiment of the present disclosure.
Figure 8:
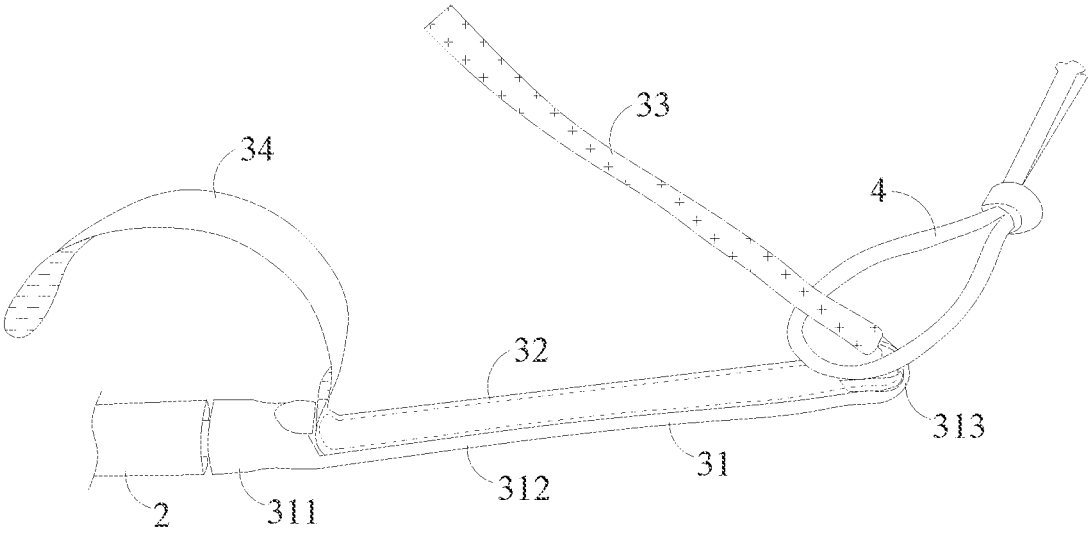
FIG. 8 is a schematic view of the board connector after it's spread according to the first embodiment of the present disclosure.
Figure 9:
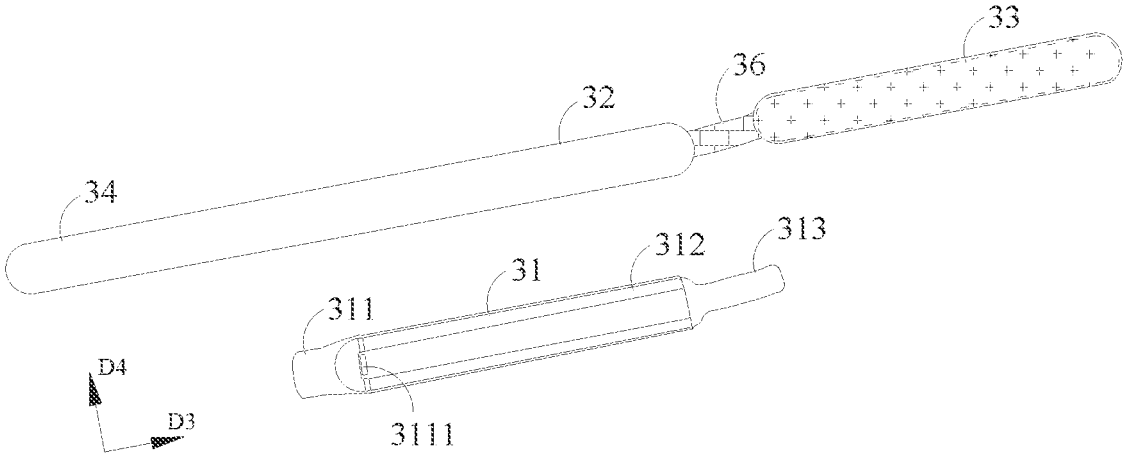
FIG. 9 is an exploded view of the board connector according to the first embodiment of the present disclosure.

As shown in FIGS. 7 to 9, in this embodiment, the board connector 3 includes a board connector body 31 and a fixing assembly. The board connector body 31 includes a fourth cooperating member 311 and a first bearing portion 312, the fourth cooperating member 311 is connected to the third cooperating member 22 of the cord 2, and the board connector body 31 is integrally molded as a one piece structure. The board connector body 31 can also be made of TPU material, but the disclosure is not limited to this. The board connector 3 can also be made of other materials with higher strength and certain flexibility. The first bearing portion 312 is used to bear and support a fixing component. Specifically, the fixing member is at least partially arranged on one side of the first bearing portion 312, and is connected to the connecting ring 4.

In the present disclosure, the length direction and width direction of the board connector 3 refer to the length direction and width direction of the board connector 3 after being spread. As shown in FIG. 9, D3 direction is the length direction of the board connector 3, and D4 direction is the width direction of the board connector 3.

As shown in FIGS. 8 and 9, in this embodiment, the fixing component includes a third fixing member 32, a second connecting strip 36 and a fourth fixing member 33. The third fixing member 32 is attached to one side of the first bearing portion 312, and one end of the fourth fixing member 33 is connected to the first end of the third fixing member 32 through the second connecting strip 36, a first surface of the fourth fixing member 33 can be separately connected to the surface of the third fixing member 32. The board connector body 31 also includes a second bearing portion 313, which is integrally molded with the first bearing portion 312, and the second bearing portion 313 is arranged outside the second connecting strip 36. In this embodiment, the first bearing portion 312 and the second bearing portion 313 have a certain flexibility. Furthermore, a width of the second bearing portion 313 is smaller than a width of the first bearing portion 312, so that the flexibility of the second bearing portion 313 is greater than the flexibility of the first bearing portion, then it is easier to bend the second bearing portion 313 to fit with the connecting ring 4.

In this embodiment, the board connector body 31 is formed in a one step process. The fourth cooperating member 311, the first bearing portion 312 and the second bearing portion 313 of the board connector body 31 are formed in a molding apparatus. Therefore, the production of the board connector body 31 is very easy and convenient, as the board connector body 31 can be obtained by using a molding apparatus in one molding step, which simplify the assembly of the board connector body 31, and greatly improves the production efficiency of the board connector body 31. The molding apparatus can be an injection molding apparatus. For example, the molding apparatus includes a mold having a cavity. The thermoplastic polyurethane elastomer material is injected into the cavity of the mold, and the board connector body 31 is obtained through one-step molding. In other embodiments, the board connector body 31 can also be made of PVC (Polyvinyl Chloride), TPE (Thermoplastic Elastomer) and other materials.

Each of the third fixing member 32 and the fourth fixing member 33 can also include a hook-and-loop fastener. The outer surface of the third fixing member 32 away from the first bearing portion 312 and the first surface of the fourth fixing member 33 can form an adhesive connection. For example, the outer surface of the third fixing member 32 is a hook surface, the first surface of the fourth fixing member 33 is a loop surface, or the outer surface of the third fixing member 32 is a loop surface, and the first surface of the fourth fixing member 33 is a hook surface. In other embodiments, the connection structure between the third fastener 32 and the fourth fastener 33 can also be a button connection structure, a snap connection structure, a threaded connection structure and any other connection structure. For example, the third fastener 32 is a button, and the fourth fastener 33 is a buttonhole. The second connecting strip 36 can be made of fabric for connecting the end of the third fixing member 32 and the end of the fourth fixing member 33, and the connecting ring 4 can be sleeved outside the second connecting strip 36. The inner surface of the second connecting strip 36 is preferably a smooth surface to avoid abrasion of the connecting ring 4. The connecting ring 4 can be a rope ring made from fabric or any other material.

As shown in FIGS. 8 and 9, to further improve the connection strength between the board connector 3 and the connecting ring 4, the board connector 3 further includes a fifth fixing member 34. One end of the fifth fixing member 34 is connected to the second end of the third fixing member 32, and a surface of the fifth fixing member 34 is separably connected to a second surface of the fourth fixing member 33. For example, the inner surface of the fifth fixing member 34 facing the fourth fixing member 33 is a round bristled surface, the second surface of the fourth fixing member 33 is a bristled surface, or the inner surface of the fifth fixing member 34 is a bristled surface, and the second surface of the fourth fixing member 33 is a round bristled surface. As shown in FIG. 9, the third fixing member 32 and the fifth fixing member 34 can be formed by using one hook-and-loop fastener. When assembling the board connector 3, the fifth fixing member 34, the third fixing member 32, the second connecting piece 36 and the fourth fixing member 33, which are connected as a long strip, can be placed at the corresponding position of the board connector body 31, and then various parts can be assembled together with sewing lines. The dotted lines in FIG. 8 represent sewing lines. Therefore, the assembling method of the board connector 3 is simpler. In addition, since the fourth cooperating member 311 is integrally formed with the first bearing portion 312 and the second bearing portion 313, the connection strength of the fourth cooperating member 311 and the first bearing portion 312 is improved to avoid the fourth cooperating member 311 from accidentally separating from the first bearing portion 312. When connecting the connecting ring 4 to the fixed component, pass the connecting ring 4 through the fourth fixing member 33 and attach it to the outside of the second connecting strip 36 firstly, stick the first surface of the fourth fixing member 33 to the outer surface of the third fixing member 32, and then stick the inner surface of the fifth fixing member 34 to the second surface of the fourth fixing member 33. When the connecting ring 4 needs to be removed, firstly separate the inner surface of the fifth fixing member 34 and the second surface of the fourth fixing member 33, then separate the first surface of the fourth fixing member 33 and the outer surface of the third fixing member 32, and remove the connecting ring 4 from the end of the fourth fixing member 33.

Figure 10:
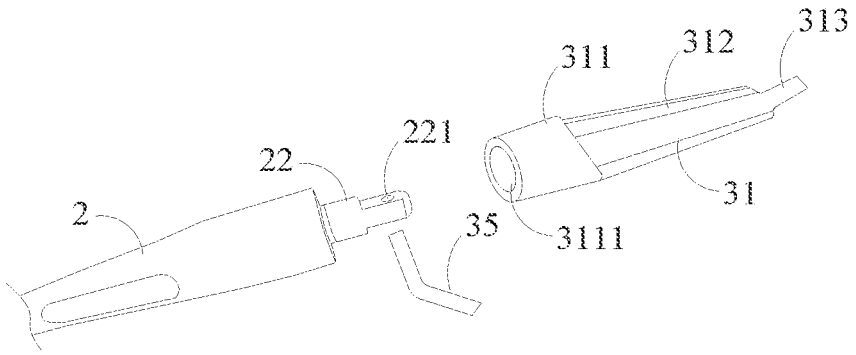
FIG. 10 is a structural schematic view of the board connector cooperating with the cord according to the first embodiment of the present disclosure.

The connection structure between the third cooperating member 22 and the fourth cooperating member 311 is shown in FIGS. 9 and 10. The first connecting strip 35 made from fabric is inserted into the third pin hole 221 of the third cooperating member 22, and then the two ends of the first connecting strip 35 are closed together and inserted into a through hole 3111 of the fourth cooperating member 311. The two ends of the first connecting strip 35 reach the position of the first bearing portion 312 together, then the first connecting strip 35 and the first bearing portion 312 are fixed together through sewing threads. After the third fixing member 32 and the fifth fixing member 34 are fixed on the first bearing portion 312, the third fixing member 32 covers the surface of the first connecting strip 35. Here is only one exemplary structure to connect the cord 2 and the board connector 3. In other embodiments, the cord 2 and the board connector 3 can also be connected in other structure, such as the connection structure similar to that between the first cooperating member 1111 and the second cooperating member 21, which also belongs to the protection scope of the disclosure. In one embodiment, the first connecting strip 35 and the second connecting strip 36 can be realized by using a same fabric strip. After being inserted into the through hole 3111 of the fourth cooperating member 311, the first connecting strip 35 extends to the position of the second bearing portion 313 and is connected to the fourth fixing part 33, that is, it is used as the second connecting strip 36. In another embodiment, the first connecting strip 35 and the second connecting strip 36 can also use two different fabric strips.

Figure 11:
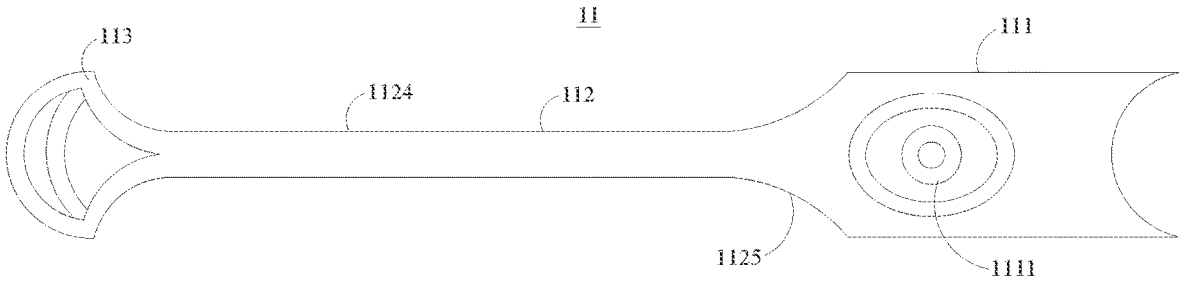
FIG. 11-13 are schematic views of an attachment strap body according to a second embodiment of the present disclosure, wherein, the pull handle members shown in FIGS. 11-13 have different shapes.
Figure 12:
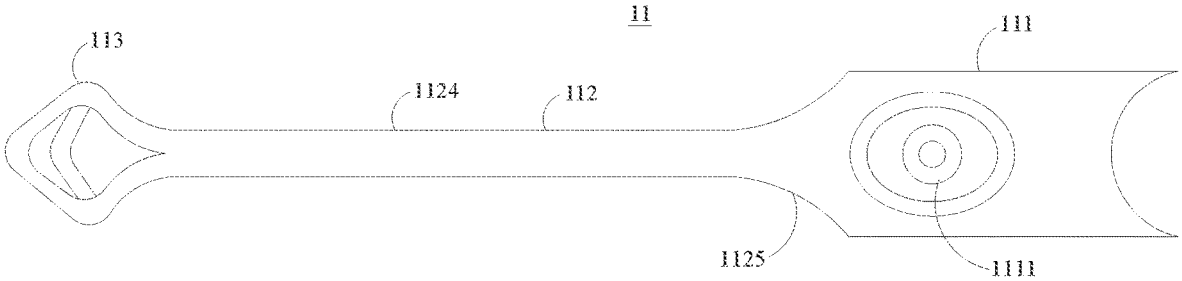
Figure 13:
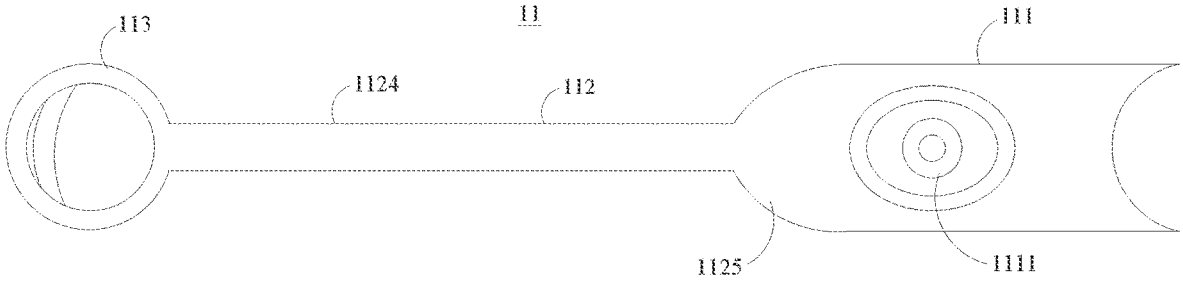

FIGS. 11 to 13 are the structural view of the attachment strap body of the attachment strap in the second embodiment of the disclosure. The difference between this second embodiment and the first embodiment shown in FIGS. 1 to 10 is that the second section 112 of the attachment strap body 11 and the pull handle member 113 are different in structure from the first embodiment. In the second embodiment, the second section 112 of the attachment strap body 11 includes a transition portion 1125 and an intermediate arm 1124. The first end of the intermediate arm 1124 is connected to the first section 111 of the attachment strap body 11 through the transition portion 1125. Specifically, the transition portion 1125 is connected to the middle position of the first section 111 in the width direction. The second end of the intermediate arm 1124 is provided with the pull handle member 113. The width of the intermediate arm 1124 is less than the width of the first section 111 of the attachment strap body 11. For example, a width of the intermediate arm 1124 is ½, or ⅓ of a width of the first section 111, etc. In the second embodiment, by reducing the width of the second section 112, the flexibility of the second section 112 can be improved, and the second section 112 can be more easily to be bent to fit the curved surface of the user's body when wearing.

FIGS. 11, 12 and 13 show three different exemplary shapes of the pull handle member 113. The shape of the pull handle member 113 can be the sector shown in FIG. 11, the diamond shown in FIG. 12, the circle shown in FIG. 13, or any other shape such as triangle and trapezoid, etc. The shape of the transition portion 1125 may correspond to or differ from the shape of the pull handle member 113.

Figure 14:
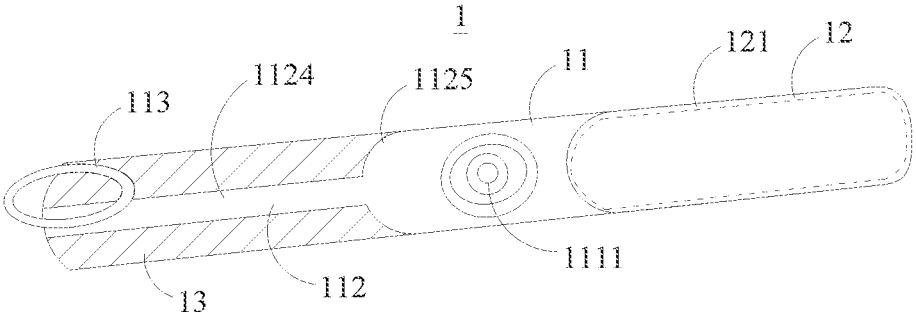
FIG. 14 and FIG. 15 are structural schematic views of the attachment strap according to a third embodiment of the present disclosure.
Figure 15:
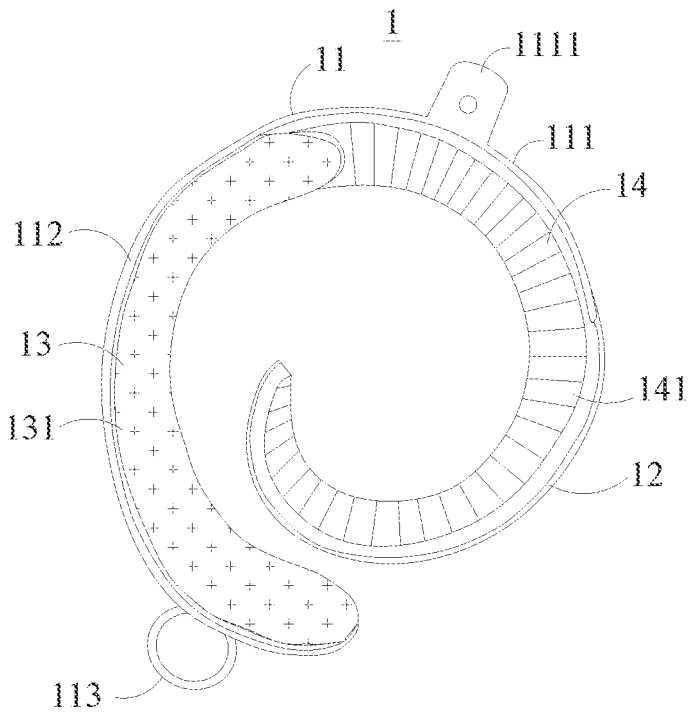

FIGS. 14 and 15 are the structural views of the attachment strap body of the attachment strap in a third embodiment of the disclosure. The third embodiment is similar to the second embodiment in that the second section 112 of the attachment strap body 11 includes a transition portion 1125 and an intermediate arm 1124. The first end of the intermediate arm 1124 is connected to the middle position of the first section 111 in the width direction through the transition portion 1125. In addition, compared to the first embodiment, the hole insertion direction of the pull handle member 113 for the user's figure in the third embodiment is different from that of the first embodiment.

For example, there are three using scenarios of the pull handle member 113: the first scenario is that the user puts on the attachment strap 1 before surfing and takes off the attachment strap 1 after surfing. In this scenario, the user has more operation time to put on and take off the attachment strap 1 with more attention, so that it is easier to find the inserting position of the pull handle member 113 for the finger; the second scenario is that when the user participates in many different kinds of competitions, in order to quickly enter the next competition after the surfing competition, the user needs to quickly take off the attachment strap 1. In this scenario, the speed of taking off is very important. How to facilitate the user to quickly insert one finger into the hole between the pull handle member 113 and the second section 112, and how to use the pull handle member 113 to take off the attachment strap 1 are more prominent; the third scenario is that the user needs to quickly separate from the surfboard when encountering dangerous situations during surfing. At this time, the user's attention is distracted, the user needs to be able to quickly find the position of the hole between the pull handle member 113 and the second section 112, insert his finger therein, and take off the attachment strap 1 by pulling the pull handle member 113. The convenience when using the pull handle member 113 also affects the safety of using the attachment strap 1.

As shown in FIGS. 1 to 3, in the first embodiment, after the attachment strap 1 is attached to the user's body part, the hole insertion direction of the pull handle member 113 is perpendicular to the length direction of the user's body part. The hole insertion direction here refers to the direction in which the user inserts his finger into the hole between the pull handle member 113 and the second section 112 when the user needs to pull the pull handle member 113. For example, when the attachment strap 1 is attached to the ankle, the hole insertion direction of the pull handle member 113 is perpendicular to the length direction of the leg. When adopting the attachment strap 1 structure of the first embodiment, the design of the vertical hole insertion direction may make it difficult for the user to locate the hole quickly, and may not meet the convenience and safety requirements when applied to the second scenario or the third scenario.

Therefore, in the third embodiment, the pull handle member 113 is further improved. As shown in FIG. 14 and FIG. 15, in the third embodiment, after the attachment strap 1 is attached to the user's body, the hole insertion direction of the pull handle member 113 is parallel to the length direction of the user's body. For example, when the attachment strap 1 is attached to the ankle, the hole insertion direction of the pull handle member 113 is parallel to the length direction of the leg. When the user needs to separate from the surfboard, the user inserts one finger into the hole between the pull handle member 113 and the second section 112, without deliberately changing the direction of the finger, and it is easier to quickly locate the hole, so as to quickly take off the attachment strap 1 from the user's body, highly improving the safety during use.

The above is a detailed description of the present disclosure in connection with the specific preferred embodiments, and the specific embodiments of the present disclosure are not limited to the description. Modifications and substitutions can be made without departing from the spirit and scope of the present disclosure.

What is claimed is:

1. A surfboard leash attachment strap comprising:

an attachment strap body comprising a first section, a second section and a pull handle member, wherein, the first section is connected to a first end of the second section, an outer surface of the first section is provided with a first cooperating member for connecting a cord, a second end of the second section is connected to the pull handle member, the attachment strap body is integrally molded as a one piece structure;

a first fixing member fixed on the first section of the attachment strap body; and a second fixing member fixed on the second section of the attachment strap body, wherein the second fixing member is separably connected to the first fixing member.

2. The attachment strap of claim 1, wherein a first end of the first fixing member is fixed at one end of the first section of the attachment strap body away from the second section.

3. The attachment strap of claim 2, wherein the attachment strap further comprises a contact member, which is at least partially attached to an inner surface of the first section of the attachment strap body and an inner surface of the first fixing member.

4. The attachment strap of claim 2, wherein when the first fixing member is connected to the second fixing member, a terminal end of the second fixing member at least partially covers the first end of the first fixing member, and the second end of the second section of the attachment strap body at least partially covers a first end of the first section.

5. The attachment strap of claim 1, wherein the first section, the second section, the first cooperating member and the pull handle member of the attachment strap body are formed in a one step process.

6. The attachment strap of claim 1, wherein the first section, the second section, the first cooperating member and the pull handle member of the attachment strap body are formed in a molding apparatus.

7. The attachment strap of claim 1, wherein the first section is preformed as an arc, and/or, at least a part of the second section is flexible.

8. The attachment strap of claim 1, wherein the second fixing member is at least partially attached to an inner surface of the second section of the attachment strap body.

9. The attachment strap of claim 1, wherein the second section of the attachment strap body is provided with a hollow portion extending along a length direction of the second section.

10. The attachment strap of claim 9, wherein the second section of the attachment strap body comprises a first arm and a second arm extending along the length direction of the second section, the hollow portion is formed between the first arm and the second arm, two ends of the pull handle member are respectively connected to the first arm and the second arm.

11. The attachment strap of claim 1, wherein the second section of the attachment strap body comprises a transition part and an intermediate arm, a first end of the intermediate arm is connected to the first section of the attachment strap body through the transition part, a second end of the intermediate arm is provided with the pull handle member, and a width of the intermediate arm is less than a width of the first section of the attachment strap body.

12. The attachment strap of claim 1, wherein after the attachment strap is attached to a human body part, an insertion direction of the pull handle member for a finger is parallel to or perpendicular to a length direction of the human body part.

13. The attachment strap of claim 1, wherein the attachment strap body is integrally formed from thermoplastic polyurethane elastomer.

14. A surfboard leash assembly comprising:

the surfboard leash attachment strap of claim 1;

a cord comprising a second cooperating member and a third cooperating member, wherein the second cooperating member is connected to the first cooperating member of the attachment strap;

a board connector connected to the third cooperating member of the cord;

a connecting ring connected to the board connector.

15. The surfboard leash assembly of claim 14, wherein the board connector comprises:

a board connector body comprising a fourth cooperating member and a first bearing portion, wherein the fourth cooperating member is connected to the third cooperating member of the cord, the board connector body is integrally molded as a one piece structure;

a fixing component at least partially arranged on a side of the first bearing portion, and connected to the connecting ring.

16. The surfboard leash assembly of claim 15, wherein the fixing component comprises a third fixing member, a connecting strip and a fourth fixing member, the third fixing member is attached to a side of the first bearing portion, one end of the fourth fixing member is connected to a first end of the third fixing member through the connecting strip, and a first surface of the fourth fixing member is separably connected to a surface of the third fixing member, the connecting ring is attached outside the connecting strip;

the board connector body further comprises a second bearing portion, the second bearing portion and the first bearing portion are integrally molded as a one piece structure, and the second bearing portion is arranged at an outside position of the connecting strip.

17. The surfboard leash assembly of claim 16, wherein the board connector further comprises a fifth fixing member, one end of the fifth fixing member is connected to a second end of the third fixing member, and a surface of the fifth fixing member is separably connected to a second surface of the fourth fixing member.

18. The surfboard leash assembly of claim 16, wherein the first bearing portion and the second bearing portion are both flexible, and/or, a width of the second bearing portion is less than a width of the first bearing portion.

19. The surfboard leash assembly of claim 15, wherein the board connector body is formed in a one step process; and/or, the board connector body is formed in a molding apparatus.

20. The surfboard leash assembly of claim 15, wherein the board connector body is formed from thermoplastic polyurethane elastomer.

* * * * *